US007669381B1

(12) United States Patent
Sorkin

(10) Patent No.: US 7,669,381 B1
(45) **Date of Patent: *Mar. 2, 2010**

(54) INTERSECTIONAL REINFORCING BAR SUPPORT

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 312 days.

This patent is subject to a terminal disclaimer.

(21) Appl. No.: 11/684,493

(22) Filed: Mar. 9, 2007

Related U.S. Application Data

(63) Continuation-in-part of application No. 11/234,756, filed on Sep. 26, 2005, now Pat. No. 7,461,491.

(51) Int. Cl.
*E04C 5/16* (2006.01)

(52) U.S. Cl. ..... 52/685; 52/686; 52/719

(58) Field of Classification Search ..... 52/685, 52/633
See application file for complete search history.

(56) References Cited

U.S. PATENT DOCUMENTS

| | | | | |
|---|---|---|---|---|
| 2,194,124 | A * | 3/1940 | Rhodes | 52/633 |
| 3,673,753 | A | 7/1972 | Anderson | |
| 3,788,025 | A | 1/1974 | Holmes | |
| 4,835,933 | A | 6/1989 | Yung | |
| 5,555,693 | A | 9/1996 | Sorkin | |
| 5,791,095 | A | 8/1998 | Sorkin | |
| 5,893,252 | A | 4/1999 | Hardy, Jr. et al. | |
| 6,112,494 | A | 9/2000 | Hardy, Jr. et al. | |
| 6,663,316 | B1 * | 12/2003 | Harris | 404/136 |
| 6,684,594 | B1 | 2/2004 | Sorkin | |
| 6,684,595 | B1 | 2/2004 | Sorkin | |
| D500,665 | S | 1/2005 | Sorkin | |
| 6,837,017 | B2 * | 1/2005 | Hardy et al. | 52/685 |
| 7,322,158 | B1 * | 1/2008 | Sorkin | 52/685 |
| 7,461,491 | B1 * | 12/2008 | Sorkin | 52/685 |
| 7,506,482 | B2 * | 3/2009 | Sorkin | 52/685 |

OTHER PUBLICATIONS

U.S. Appl. No. 11/234,756, filed Sep. 26, 2005, F.L. Sorkin.

* cited by examiner

*Primary Examiner*—Richard E Chilcot, Jr.
*Assistant Examiner*—Alp Akbasli
(74) *Attorney, Agent, or Firm*—Egbert Law Offices PLLC

(57) ABSTRACT

A concrete reinforcing bar support has a base, a support structure extending upwardly from the base and having a channel formed in an upper surface thereof, a first clamping structure affixed to the support structure on one side of the channel and a second clamping structure affixed to the support structure on an opposite side of the channel. The base is a generally planar surface. The channel has a length dimension that is less than a length dimension of the base. The support structure has first and second side panels extending vertically upwardly from the base to a bottom of the first and second clamping structures.

16 Claims, 2 Drawing Sheets

INTERSECTIONAL REINFORCING BAR SUPPORT

RELATED U.S. APPLICATIONS

The present application is a continuation-in-part of U.S. application Ser. No. 11/234,756, filed on Sep. 26, 2005, and entitled "Intersectional Reinforcing Bar Support Having Securing Cap", presently pending.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to devices for use in connection with construction. More particularly, the present invention relates to a reinforcing bar chair apparatus for use in reinforced concrete construction. Furthermore, the present invention relates to intersectional chairs used with reinforced concrete construction.

BACKGROUND OF THE INVENTION

In reinforced concrete construction applications, such as highways, floors, or walls of buildings, spacer devices, commonly referred to as chairs, are required for supporting and maintaining reinforcing rods or bars which are positioned in the area where concrete is to be poured. These reinforcing rods are sometimes referred to as "rebars". Depending on parameters, such as the total surface area and the thickness of the end product of concrete, reinforcement is mandated in varying degrees by building codes. One such method of reinforcement involves a steel mesh, while in major concrete construction, such as highways and high-rise buildings, reinforcing rods of various diameters, typically one-half inch or more, are required. In addition, on such jobs, the reinforcing bars may be positioned in spaced layers due to the thickness of the floor. In some installations, a first layer of rebar is provided, with the reinforcing rods or rebars in spaced parallel relationship, and generally parallel to the surface on which the concrete is to be poured. A second layer of rebar is then added, with the orientation of the second layer perpendicular to the first layer, thus forming a grid or lattice work. After the reinforcing bars or lattice work is prepared, the concrete is then poured over this grid or framework, which is ultimately embedded within the highway floor or wall.

For a concrete floor on a prepared surface, spacers or chairs are utilized for providing the vertical separation of the rebar grid from the surface on which the concrete is to be poured. The prepared surface may be a wood, plywood, or foam structure or a compacted surface, the latter of which my be provided with a layer of compacted sand, with a plastic sheet covering thereon providing a moisture barrier. Spacers or chairs are then positioned on the prepared surface for supporting the rebars in a plane generally parallel to the prepared surface. Typically, with modern building codes, a spacer is needed for every linear foot of the rebar.

With rebar spacers or chairs, one common problem is occasioned by the number of different sizes required to be maintained by a supplier to accommodate different thicknesses of poured concrete, such as two-inch, three-inch, four-inch, etc. and many intermediate fractional sizes. Another common problem with rebar spacers has been encountered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire secures the perpendicular layer of rebar. With any metal or wire within the reinforcing bar grid work, there is a problem with rusting or decomposing of the wire or metal components.

Since the intersectional bar supports are used to support a large number of rebars in a desired spaced relationship above an underlying surface, industry standards have required that such intersectional reinforcing bar supports pass a "dragging" test. The purpose of the "dragging" test is to avoid any collapse of the mesh of rebars in the event that a dragging or displacement force is applied to the rebars. Since the mesh of rebars can have a very considerable weight, potential injury can occur if a pulling force is applied to the mesh of rebars and the mesh collapses onto the underlying surface. As such, the "dragging" test is applied by attaching a line to the mesh of rebars and pulling on the line to see if the reinforcing bar supports can withstand a fixed level of pulling force. As such, it is very important in the construction of such reinforcing bar supports to have a structure which strongly resists the dragging forces and avoids any potential collapse of the mesh rebar configuration.

When reinforcing bar supports are used to support a mesh of rebars above an underlying surface, it is very important to facilitate the flow of concrete in and around the mesh of rebars and in and around the reinforcing bar supports. If the reinforcing bar supports present too many obstacles to the flow of concrete, then voids in the concrete are possible. As such, it is very desirable to create such reinforcing bar supports which completely facilitate the flow of concrete while, at the same time, maintain the structural integrity of the bar support.

Since such reinforcing bar supports are relatively inexpensive items, it is important to be able to minimize the cost associated with the production of such reinforcing bar supports. Although the polymeric material used for the creation of such bar supports is relatively inexpensive, it is important to avoid unnecessary waste of the polymeric material. The cost of such polymers can add to the ultimate cost of the reinforcing bar support. It is important to be able to minimize the amount of polymer that is used for the creation of such bar supports while, at the same time, maintaining the strong structural integrity of such bar supports. Additionally, the minimization of the use of polymer in the formation of reinforcing bar supports will further minimize the costs associated with the transportation, delivery and storage of such reinforcing bar supports. By minimizing the weight associated with each of the bar supports, a larger number of bar supports can be transported to the construction site. Additionally, by minimizing the weight of the bar supports, the worker can more easily transport a relatively large number of bar supports to the desired location at the construction site. This further enhances the ability of the bar supports to minimize potential back injuries to the construction worker.

In the past, various patents have issued relating to these chair supports for reinforcing rods. In particular, the present inventor is the owner of U.S. Pat. Nos. 5,555,693 and 5,791,095 for such chairs. Each of these chairs has a receiving area with a horizontal section and a generally parabolic section extending transverse to the horizontal section. A plurality of separate legs extends downwardly from the receiving area.

Each of the legs has a foot extending horizontally outwardly therefrom. The receiving area and the plurality of legs are integrally formed together of a polymeric material.

U.S. Pat. No. 3,788,025, issued on Jan. 29, 1974, to S. D. Holmes, describes a chair for supporting in right angular relation two reinforcing rods used in construction. The chair has a lower arched base part and an upper rod supporting part integral with the base. The base is an arched support with means for providing lateral, longitudinal, vertical support and strength. The rod supporting part comprises two spaced apart arms, the lower parts of which form a saddle for receiving one reinforcing rod and the upper part for each of which is formed by two separate spaced upstanding inwardly concave arms, the upper ends of which are spaced to provide an opening through which a second reinforcing rod, arranged at a right angle to the first rod, may be introduced.

U.S. Pat. No. 3,673,753, issued on Jul. 4, 1972, to G. C. Anderson, teaches a concrete reinforcing bar support in which a base supports an upright pedestal. A lower clamping portion is supported by the pedestal which has a first rod-receiving open passageway therethrough. Resilient detents extend from the lower clamping portion to retain a reinforcing rod disposed through the first passageway. An upper clamping portion is provided which includes a pair of hook members extending from the lower clamping portion. Each of the hook members has a mouth opening in the same direction to define a second rod-receiving passageway which is normally disposed to the first passageway.

U.S. Pat. No. 4,835,933, issued on Jun. 6, 1989, to F. P Yung, describes a spacer assembly which includes a spacer with a body having a base portion with a generally centrally disposed support post portion. One end of the support post portion is formed as a planar surface with a centrally located generally concave saddle portion configured for receiving a reinforcing bar. The planar surface is provided with apertures therethrough on both sides of the saddle. A clamp member is provided for simultaneously securing mutually perpendicular rebars to the chair. The clamp member is a generally U-shaped lower portion, with the depending arms thereof in spaced generally parallel relationship for engaging a first bar within the saddle. A generally identical pair of hook arms extends upwardly from the bight portion. The hook arms are oriented for engaging a second rebar in an orientation perpendicular to the first rebar engaged within the saddle portion.

U.S. Pat. No. 5,893,892, issued on Apr. 13, 1999, to Hardy, Jr. et al, teaches an apparatus for fixating and elevating an interconnected rebar lattice having individual longitudinal and transverse rebar intersections. The apparatus includes a holding portion having an open-ended recess with two opposing walls being generally U-shaped. The recess has longitudinal access and is sized and shaped to receive a longitudinal rod. An arc-shaped portion extends laterally outwardly from each opposing wall and perpendicular to the longitudinal access of the recess. The arc-shaped portion includes a recess and an opposing wall with each wall including a snap-type lock. A locking member has a generally arc-type portion and includes a snap-type lock for attaching to the arc-type portion and engaging with the snap-type lock of the arc-type portion. A leg portion extends downwardly from the holding portion and is integrally attached to a base.

U.S. Pat. No. 6,112,494, issued on Sep. 5, 2004, to Hardy, Jr. et al., teaches a system for affixing rebar lattice. The apparatus includes a holding portion having an open ended recess with two opposing walls being generally U-shaped. The recess has a longitudinal axis and is sized and shaped to receive a longitudinal rod. An arc-shaped portion extends lateral outwardly from each opposing wall and perpendicular to the longitudinal axis of the recess. The arc-shaped portion includes a recess and opposing walls including a snap-type lock. A locking member having a generally arc-shaped portion and includes a snap-type lock for attaching to the arc-shaped portions and engaging with the snap-type lock of the arc-shaped portions. A holding member is adapted to secure the individual longitudinal and transverse rebar intersections of the rebar lattice in a locking relationship while the leg portion holds the interconnected rebar lattice in a preselected elevated position.

The present inventor is the owner of several U.S. patents relating to such intersectional rebar chairs. For example U.S. Pat. No. 6,684,594, issued on Feb. 3, 2004, to the present inventor, describes a concrete reinforcing bar support having a base, a support structure extending upwardly from the base and a having a channel formed in an upper surface thereof, a first clamping structure affixed to the support structure on a side of the channel, and a second clamping structure affixed to the support structure on an opposite side of the channel. A first rebar extends through the channel. A second rebar is retained by the first and second clamping structures in a direction transverse to the first rebar. The retaining elements are provided on the clamping structures so as to engage the rebar when it is received within the second clamping structure. Lever elements extend outwardly from the clamping structure so as to provide a funneling type of structure so as to facilitate the introduction of the rebar into the second clamping structure.

U.S. Pat. No. 6,684,595, issued on Feb. 3, 2004, to the present inventor, teaches another type of intersectional reinforcing bar support. This bar support also includes a base, a support structure extending upwardly from the base and having a channel formed at an upper surface thereof, a first clamping structure affixed to the support structure on a side of the channel, and a second clamping structure affixed to the support structure on an opposite side of the channel. Each of the clamping structures has a curved element extending inwardly therefrom. A first rebar extends through the channel. A second rebar is retained by the first and second clamping structures in a direction transverse to the first rebar. A self adjusting retention mechanism is provided on a side of the second clamping structure opposite the curved surface so as to retain the rebar in a proper position therein.

U.S. Design Pat. No. D500,665, issued on Jan. 11, 2005, to the present inventor, teaches a unique design for such an intersectional rebar chair. A channel is formed at the top of the support structure. A pair of C-shaped clamping structures are located on opposite sides of the channel. The lipped element extends across the open face of the C-shaped members so as to facilitate the introduction of rebar into the interior of such C-shaped members.

U.S. application Ser. No. 11/234,756, from which the present application claims priority, describes an intersectional reinforcing bar support having a securing cap. In this reinforcing bar support, several holes are formed on the support structure. Although these holes facilitate the flow of concrete, it was found to be desirable to maximize through spaces formed in the support structure beyond those evidenced by the holes in the prior application. Additionally, in order to enhance the ability to pass a "dragging" test, it was felt desirable to expand the length dimension of the base such that the base extends for a greater distance than that of the channel which supports the transverse rebar. It was found that, under certain circumstances, it was not necessary to include the cap which extends over the clamping structures.

It is an object of the present invention to provide a bar support which is corrosion-proof.

It is another object of the present invention to provide a bar support adapted for use at intersections of rebars.

It is another object of the present invention to provide a bar support that can be placed on various flat surfaces.

It is another object of the present invention to provide a bar support that can be easily snap-fitted onto and locked around a reinforcing bar.

It is another object of the present invention to provide a bar support which allows a free flow of concrete therethrough.

It is a further object of the present invention to provide a bar support with a load-resistant stable support structure.

It is a further object of the present invention to provide a reinforcing bar support which is easy to use, easy to manufacture and relatively inexpensive.

It is another object of the present invention to provide a channel for such an intersectional chair which is suitably reinforcing so as to enhance the ability to retain the rebar within the channel.

It is still another object of the present invention to provide an intersectional chair which maximizes the ability to resist dragging forces applied to the mesh that is supported by the intersectional chair.

It is still a further object of the present invention to provide an intersectional chair which maximizes the structural integrity of the chair while minimizing the amount of polymer that is used in the formation of the chair.

These and other objects and advantages of the present invention will become apparent from the reading of the attached specification and appended claims.

BRIEF SUMMARY OF THE INVENTION

The present invention is a concrete reinforcing bar support that has a base, a support structure extending upwardly from the base and having a channel formed in an upper surface thereof, a first clamping structure affixed to the support structure on one side of the channel and having an interior surface suitable for receiving a rebar therein, and a second clamping structure affixed to the support structure on an opposite side of the channel and having an interior surface suitable for receiving the rebar therein. The channel extends in a direction and has a size suitable for receiving another rebar therein which extends transverse to the first rebar. The second clamping structure is in spaced relationship to the first clamping structure. The base has a generally planar surface with a length dimension and a width dimension. The channel has a length dimension that is less than the length dimension of the base. Each of the first and second clamping structures includes a first C-member extending flexibly upwardly from the support structure, and a second C-shaped member extending flexibly upwardly from the support structure. The first and second C-shaped members face in opposite directions. The first C-shaped member of the first and second clamping structures is located between the second C-shaped member and a respective side of the channel.

In the present invention, the support structure has a width dimension that is less than the width dimension of the base. The support structure has a first side panel extending vertically upwardly from the base to a bottom of the second C-shaped member of the first clamping structure and a second side panel extending vertically upwardly from the base to a bottom of the second C-shaped member of the second clamping structure. The support structure has a plurality of transverse members extending between the first and second side panels. A plurality of diagonal members extend respectively between the first and second side panels and the plurality of transverse members. A pair of interior panels extend in parallel relationship to each other and in parallel relationship to the first and second side panels and are located between the first and second side panels. The first and second side panels and the plurality of transverse members and the plurality of diagonal members define through spaces in the support structure. The support structure has a wall formed directly below the channel. Each of the first and second side panels has a bottom which flairs outwardly toward opposite edges of the base.

The first C-shaped members of the first and second clamping structures face in the same direction. The second C-shaped members of the first and second clamping structures also face in the same direction. Each of the first and second C-shaped members has a flange element extending angularly upwardly and outwardly therefrom at a top thereof.

In the present invention, the channel is a generally semi-cylindrical channel having a first end and a second end. A first gusset extends from the support structure to a bottom of the channel at the first end. A second gusset extends from the support structure to a bottom of the channel at the second end.

DETAILED DESCRIPTION OF THE INVENTION

Figure 1:
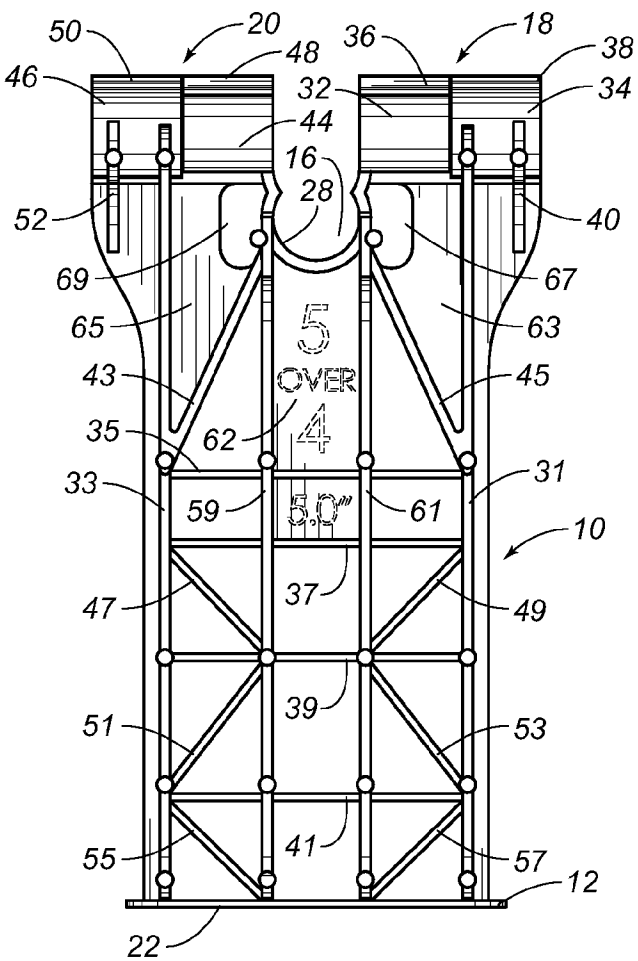
FIG. 1 is a frontal view of the intersectional bar support of the present invention.

Referring to FIG. 1, there is shown the intersectional bar support 10 in accordance with the preferred embodiment of the present invention. The intersectional bar support 10 includes a base 12 having a support structure 14 extending upwardly therefrom. A channel 16 is formed at an upper surface of the support structure 14. A first clamping structure 18 is affixed to the support structure 14 at a top thereof on one side of the channel 16. A second clamping structure 20 is affixed to the support structure 14 on an opposite side of the channel 16 and in spaced relationship to the first clamping structure 18. The channel 16 extends in a direction and has a size suitable for receiving a first rebar therein. The first clamping structure 18 has an interior suitable for receiving a second rebar therein extending in a direction transverse to the first rebar. Similarly, the second clamping structure 20 has an interior suitable for receiving the second rebar therein.

The base 12 is a planar member having a length dimension and a width dimension. The base has a generally flat bottom surface 22. The base 12 facilitates the ability of the bar support 10 to be placed upon a flat underlying surface. The support structure 14 is formed with the base 12 and extends vertically upwardly therefrom. The base 12 has a particular configuration so as to resist "dragging" effects and to facilitate the ability to resist any displacement or dislodgement of a rebar mesh structure received within the clamping structures.

The first clamping structure 18 is located on one side of the channel 16 at the top of the support structure 14. The first clamping structure 18 includes a first C-shaped member 32 and a second C-shaped member 34. The first C-shaped member 32 extends flexibly upwardly from the support structure 14. Similarly, the second C-shaped member 34 also extends flexibly upwardly from the support structure 14. The first C-shaped member 32 faces in a direction opposite to that of the second C-shaped member 34. The first C-shaped member 32 is located between the second C-shaped member 34 and the channel 16. A first flange element 36 extends angularly upwardly and outwardly of the first C-shaped member 32. A second flange element 38 extends upwardly and outwardly of the second C-shaped member 34. These flange elements 36 and 38 facilitate the ability to introduce a rebar into the space between the first C-shaped member 32 and the second C-shaped member 34. Additionally, if required, the flange elements 36 and 38 can allow for a cap to be slidably positioned thereover and thereto.

A reinforcing rib 40 extends upwardly from the support structure 14 toward the second C-shaped member 34. The reinforcing rib 40 extends around the back of the second C-shaped member 34 so as to generally terminate at the flange element 38. The placement of the reinforcing rib 40 in the position illustrated in FIG. 1 enhances the structural integrity of the second C-shaped member 34. The reinforcing rib 40 will resist the deflection of the support structure 14 upon the application of a compressive load thereof.

The second clamping structure 20 has a similar configuration to that of the first clamping structure 18. In particular, the second clamping structure 20 includes a first C-shaped member 44 and a second C-shaped member 46. A flange element 48 extends upwardly and outwardly of the top of the first C-shaped member 44. A flange element 50 extends upwardly and outwardly of the second C-shaped member 46 of the second clamping structure 20. The clamping structures 32 and 44 face in the same direction. The first C-shaped member 44 is interposed between the second C-shaped member 46 on the opposite side of the channel 16 from the first clamping structure 18. The second C-shaped members 34 and 46 also face in the same direction. A reinforcing rib 52 extends in parallel relationship to the reinforcing rib 40 in a manner similar to that described in association with the first clamping structure 18. The clamping structures 18 and 20 are similarly integrally formed with the support structure 14 in an injection molding process.

The support structure 14 of the present invention has a very unique configuration. This unique configuration facilitates the ability for concrete to flow through the structure while, at the same time, maintaining the structural integrity of the reinforcing bar support 10 and, also, minimizing the amount of polymer used for the formation of the reinforcing bar support 10. The support structure 14 includes a first side panel 31 extending vertically upwardly from the base 12 to a bottom of the second C-shaped member 34 of the first clamping structure 18. The support structure 14 also includes a second side panel 33 extending vertically upwardly from the base 12 to a bottom of the second C-shaped member 46 of the second clamping structure 20. Side panels 31 and 33 are generally of a planar configuration and extend in spaced parallel relationship to each other. The base 12 has a width dimension that is greater than the distance between the first side panel 31 and the second side panel 33. A plurality of transverse members 35, 37, 39 and 41 extend between the first side panel 31 and the second side panel 33. The transverse members 35, 37, 39 and 41 are in generally spaced parallel relationship to each other. A plurality of diagonal members 43, 45, 47, 49, 51, 53, 55 and 57 extend respectively between the at least some of the transverse members 35, 37, 39 and 41. Diagonal members 55 and 57 extend between the transverse member 41 and the base 12. The diagonal member 43 extends between the transverse member 35 and the bottom of the channel 16. Similarly, the diagonal member 45 extends between the bottom of the channel 16 and the transverse member 35. There are no diagonal members located between the transverse member 35 and 37. The diagonal members 43, 45, 47, 49, 51, 53, 55 and 57 will extend respectively inwardly between the first side panel 31 and the second side panel 33. The arrangement of the various transverse members and diagonal members facilitate the structural integrity of the reinforcing bar support 10 while, at the same time, maximizing the number of through spaces provided on the interior of the support structure 14. The support structure 14 also includes a pair of interior panels 59 and 61 which extend in generally parallel relationship to each other and are located in parallel relation to and between the side panels 31 and 33. A wall 62 of solid polymeric material is formed at the underside of the channel 16 and between the interior panels 59 and 61 and also above the transverse member 35. Additionally, wall 63 is formed at the underside at the first clamping structure 18 and extends upwardly from the diagonal member 45 and within the side panel 31. Similarly, a wall 65 extends below the second clamping structure 20 and above the diagonal member 43. The use of the walls 62, 63 and 65 enhances the structural integrity of the reinforcing bar support 10 in the area adjacent to where the maximum forces will be applied (i.e. where the rebars are positioned within the channel 16 and within the clamping structures 18 and 20).

Voids 67 and 69 are formed adjacent to the sides of the channel 16 to facilitate the ability of the channel 16 to flex properly for the receipt of rebar therein. Void 67 is located directly below the C-shaped member 32 of the first clamping structure 18. The void 69 is located directly below the C-shaped member 44 of the second clamping structure 20.

The arrangement of the reinforcing bar support 10 in accordance with the teachings of FIG. 1 maximizes the ability of the reinforcing bar support 10 to withstand the weight of the rebar received therein while, at the same time, minimizing the amount of polymer that is used for the formation of the bar support 10. The present invention, through its unique engineering arrangement of the side panel, the diagonal members and the transverse members, creates a bridge-type structure so as to maximize the number of through spaces in the support structure 10. The use of the various walls 62, 63 and 65 places structural integrity where it is needed most. As such, the weight of the bar support 10 is minimized while the structural integrity is maximized. The maximization of through spaces formed in the support structure 10 also serves to avoid any accumulation of voids within the concrete structure in the area of the bar supports 10.

Figure 2:
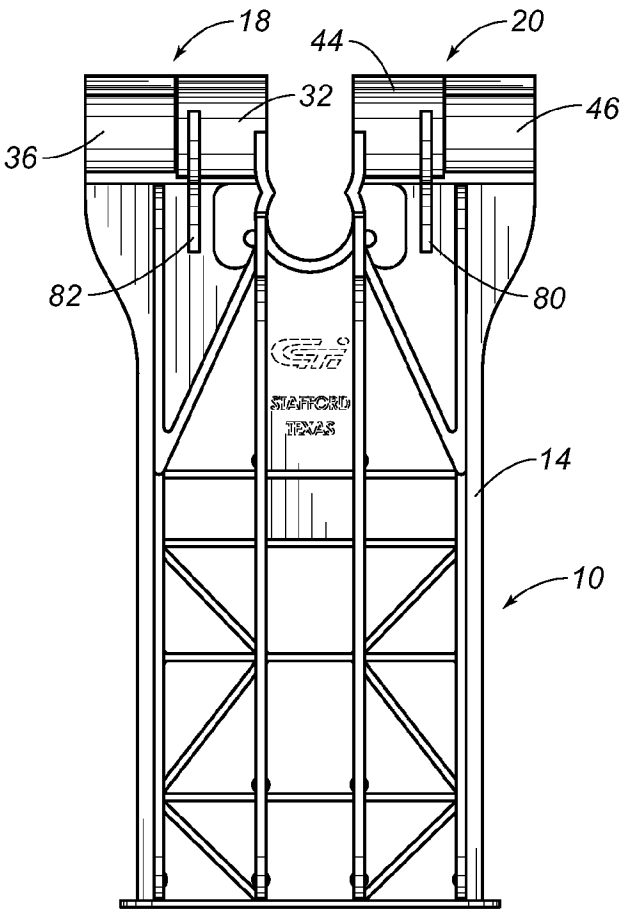
FIG. 2 is a rear view of the intersectional bar support of the present invention.

FIG. 2 shows the opposite side of the bar support 10 in accordance with the present invention. In FIG. 2, it can be seen that there is a rib 80 which extends from the support structure 14 over the back of the C-shaped member 44 of the second clamping structure 20. Another rib 82 extends from the support structure 14 over the back of the C-shaped member 32 of the first clamping structure 18. Once again, ribs 80 and 82 serve to maximize the structural integrity of the C-shaped members 32 and 44. In all other respects, the rear view of the bar support 10, as illustrated in FIG. 2, reflects the structure of the bar support 10 in FIG. 1.

Figure 3:
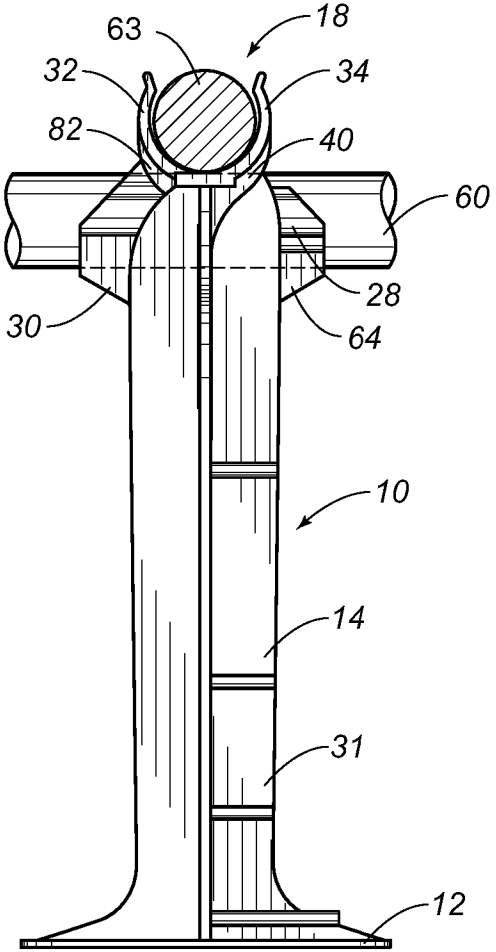
FIG. 3 is a side elevational view showing the intersectional bar support of the present invention with rebars extending through the channel and through the clamping structures.

FIG. 3 illustrates the manner in which the first rebar 60 and the second rebar 63 are retained within the bar support 10 of the present invention. In FIG. 3, it can be seen that the semi-cylindrical channel 28 has rebar 60 extending therethrough. A first gusset 30 supports one end of the channel 28. Another gusset 64 supports an opposite end of the channel 28. The channel 28 extends outwardly on opposite sides of the support structure. As can be seen, the channel 28 has a length dimension. Importantly, the base 12 has a length dimension that is greater than that of the length dimension of the channel 28. Tests have shown that the extended length of the base 12, and its length being longer than that of the channel 28, facilitates the ability of the bar support 10 to comply with "dragging" tests. In other words, the extended length of the base avoids any adverse pivoting of the bar support 10 during dragging. Additionally, the planar shape of the base 12 can dig into the underlying surface during the dragging test so as to be resistive of the dragging effect. As a result, the bar support 10 facilitates safety when used in conjunction with the rebar mesh.

In FIG. 3, the rebar 63 is retained between the C-shaped members 32 and 34 of the clamping structure 18. The C-shaped member 32 is reinforced by the reinforcing rib 82 extending from the support structure 14. Similarly, the C-shaped member 34 is reinforced by reinforcing rib 40 and also extends from the support structure 14. The reinforcing rib 82 has a bottom which resides in close proximity to the top of the rebar 60. The rebar 60 extends in a direction transverse to that of rebar 63.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A concrete reinforcing bar support comprising:

a base having a generally planar surface with a length dimension and a width dimension;

a support structure extending upwardly from said base, said support structure having a channel formed in an upper surface thereof, said channel extending in a direction and having a size suitable for receiving a first rebar therein, said channel having a first end extending outwardly beyond one side of said support structure, said channel having a second end extending outwardly beyond an opposite side of said support structure, said channel having a length dimension from said first end to said second end that is less than said length dimension of said base;

a first clamping structure affixed to said support structure on one side of said channel, said first clamping structure having an interior surface suitable for receiving a second rebar therein extending in a direction transverse to the first rebar; and a second clamping structure affixed to said support structure on an opposite side of said channel, said second clamping structure having an interior surface suitable for receiving the second rebar therein, said second clamping structure being in spaced relationship to said first clamping structure, each of said first and second clamping structures comprising:

a first C-shaped member extending flexibly upwardly from said support structure; and a second C-shaped member longitudinally offset from said first C-shaped member along said support structure and extending flexibly upwardly from said support structure, said first and second C-shaped members facing in opposite directions, said first C-shaped member of said first clamping structure located between said second C-shaped member and one side of said channel.

2. The bar support of claim 1, said support structure having a width dimension that is less than said width dimension of said base.

3. The bar support of claim 1, said support structure having a first side panel extending vertically upwardly from said base to a bottom of said second C-shaped member of said first clamping structure and a second side panel extending vertically upwardly from said base to a bottom of said second C-shaped member of said second clamping structure.

4. The bar support of claim 3, said support structure having a plurality of transverse members extending between said first and second side panels.

5. The bar support of claim 4, said support structure having a plurality of diagonal members extending respectively between at least some of said plurality of side panels and said plurality of transverse members.

6. The bar support of claim 3, said support structure having a pair of interior panels extending in parallel relationship to each other and positioned in parallel relationship and between said first and second side panels.

7. The bar support of claim 5, said plurality of side panels and said plurality of transverse members and said plurality of diagonal members defining through spaces in said support structure.

8. The bar support of claim 1, said support structure having a wall formed directly below said channel.

9. The bar support of claim 3, each of said first and second side panels having a bottom flaring outwardly toward opposite edges of said base.

10. The bar support of claim 1, said first C-shaped members of said first and second clamping structures facing in the same direction, said second C-shaped members of said first and second clamping structures facing in the same direction.

11. The bar support of claim 1, each of said first and second C-shaped members having a flange element extending angularly upwardly and outwardly therefrom at a top thereof.

12. The bar support of claim 3, said channel comprising:

a generally semi-cylindrical channel;

a first gusset extending from a bottom of said channel at said first end of said channel to said support structure; and a second gusset extending from a bottom of said channel at said second end of said channel to said support structure.

13. A concrete reinforcing bar support comprising:

a base having a generally planar surface with a length dimension and a width dimension;

a support structure extending upwardly from said base, said support structure having a channel formed in an upper surface thereof, said channel extending in a direction and having a size suitable for receiving a first rebar therein;

a first clamping structure affixed to said support structure on one side of said channel, said first clamping structure having an interior surface suitable for receiving a second rebar therein extending in a direction transverse to the first rebar; and a second clamping structure affixed to said support structure on an opposite side of said channel, said second clamping structure having an interior surface suitable for receiving a second rebar therein, said second clamping structure being in spaced relationship to said first clamping structure, said support structure having a first side panel extending vertically upwardly from said base to a bottom of said first clamping structure and a second side panel extending vertically upwardly from said base to a bottom of said second clamping structure, said support structure having a plurality of transverse members extending between said first and second side panels and a plurality of diagonal members extending respectively between said first and second side panels and said plurality of transverse members, said support structure having a pair of interior panels extending in parallel relationship to each other and in parallel relationship to said first and second side panels and between said first and second side panels, said first and second side panels and said plurality of transverse members and said plurality of diagonal members defining through spaces in said support structure.

14. The bar support of claim 13, said support structure having a wall formed directly below said channel.

15. The bar support of claim 13, said channel having a length dimension that is less than said length dimension of said base.

16. The bar support of claim 13, each of said first and second side panels having a bottom flaring outwardly toward opposite edges of said base.

* * * * *